US005978996A

United States Patent [19]

Ullman

[11] Patent Number: 5,978,996

[45] **Date of Patent: *Nov. 9, 1999**

[54] SHOE TREE ASSEMBLY

[76] Inventor: Allan Ullman, 1 Rosalind Pl., Lawrence, N.Y. 11599

[ * ] Notice: This patent issued on a continued prosecution application filed under 37 CFR 1.53(d), and is subject to the twenty year patent term provisions of 35 U.S.C. 154(a)(2).

[21] Appl. No.: 08/741,677

[22] Filed: Oct. 31, 1996

[51] Int. Cl.[6] ..... A43D 12/00

[52] U.S. Cl. ..... 12/129.4; 12/128 B

[58] Field of Search ..... 12/129.4, 128 B, 12/128 R

[56] References Cited

U.S. PATENT DOCUMENTS

| | | | |
|---|---|---|---|
| 2,070,858 | 2/1937 | Des Jardins et al. | 12/129.4 |
| 2,269,006 | 1/1942 | Clark | 12/129.4 |
| 2,481,930 | 9/1949 | Katchel | 12/129.4 |
| 2,510,315 | 6/1950 | Malberg | 12/128 B |
| 3,772,722 | 11/1973 | Gellert | 12/128 B |
| 4,517,443 | 5/1985 | Dollst | 12/129.4 |
| 4,667,817 | 5/1987 | Im et al. | 12/128 B |
| 4,981,651 | 1/1991 | Horng | 422/24 |

FOREIGN PATENT DOCUMENTS

| | | | |
|---|---|---|---|
| 249906 | 12/1987 | European Pat. Off. | 12/129.4 |
| 287660 | 3/1928 | United Kingdom | 12/129.4 |

*Primary Examiner*—M. D. Patterson
*Attorney, Agent, or Firm*—F. Chau & Associates, LLP

[57] ABSTRACT

A shoe tree assembly includes a shoe tree and an electrically operated disinfecting device such as an ultraviolet light emitting lamp. The shoe tree is inserted in a shoe and the disinfecting lamp inhibits the growth of fungi and other microorganisms, particularly those which cause athlete's foot or unpleasant odor. A control box for operating the lamp can include a timer and ballast.

6 Claims, 5 Drawing Sheets

121
120
125
122
123
122
124
103
114
113
104
112
111
102
133
138
132
136
135
117
130
119
139
138
134
118
137
116
118
115
131

SHOE TREE ASSEMBLY

BACKGROUND

1. Field of the Invention

The present invention relates to a shoe tree apparatus and particularly to a shoe tree assembly having means for performing disinfectant or fungicidal functions.

2. Background of the Art

Shoe trees are commonly used to maintain the shape of shoes when they are not being worn. Shoe trees typically have a forepart adapted to fit in the vamp portion of a shoe, a central tube or shaft, optionally with a spring, and a heel portion.

The leather of the shoes generally absorbs moisture from, for example, the user's foot, or external conditions such as rain or snow. Use of a shoe tree prevents the shoe from curling as the leather gradually dries.

The moist and warm interior of a shoe also provides ideal conditions for the growth of microorganisms, particularly fungus. Such microorganism and fungus can reside in the shoe, causing unpleasant odor or fungal related problems such as athlete's foot. Shoe borne fungal problems are particularly troublesome because after treatment with drugs, medicated ointment and the like, the foot can be easily reinfected when the user returns to wearing shoes still harboring the fungus.

It would be advantageous to have a shoe tree which disinfects the interior of the shoe, thereby, preventing reinfections of foot fungus and maintaining both the shape and freshness of the shoe.

SUMMARY

A shoe tree assembly is provided herein for disinfecting the interior of a shoe from microorganism such as fungus. The shoe tree assembly includes a shoe tree configured to fit within the interior of a shoe, and an electrically operated disinfecting apparatus. The shoe tree may be any structure capable of fitting into a shoe and may include a forepart, a spine, and an adapter piece adjustably connected to the spine. The electrically operated disinfecting apparatus can comprise a light source capable of emitting a biocidal wavelength of light, such as ultraviolet radiation. The shoe tree assembly preferably includes means for mounting a light source, such as a socket, which is releasably secured to the shoe tree. The light source is preferably connected to a control box having a timer and/or an electrical ballast. The control box may provide power to more than one lamp. The control box includes a plug for insertion into a wall socket. The plug preferably includes means for receiving another plug for providing electrical connection to another similarly equipped shoe tree.

BRIEF DESCRIPTION OF THE DRAWINGS

Various embodiments are described below with reference to the drawings wherein.

DETAILED DESCRIPTION OF PREFERRED EMBODIMENTS

Figure 1:
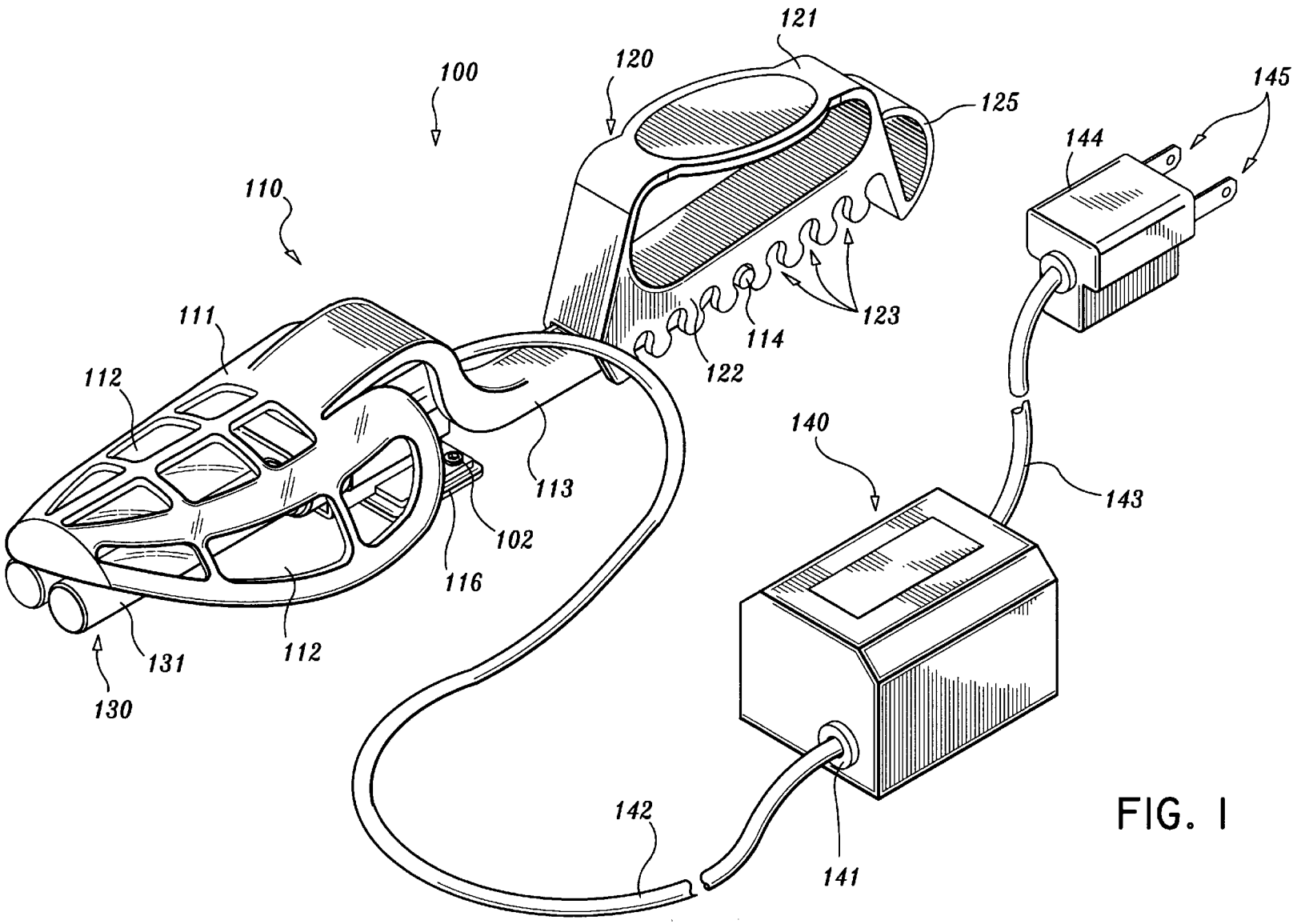
FIG. 1 is a perspective view of the shoe tree assembly.

Referring to FIGS. 1–4, shoe tree assembly 100 includes a shoe tree 110 and an electrically operated apparatus for treating a shoe, which in a preferred embodiment includes a lamp 130 for disinfecting treatment.

More particularly, in a preferred embodiment shoe tree 110 includes a forepart 111 configured and dimensioned to fit within the vamp portion of the shoe and to provide a structural support to maintain a desired shape. The shoe tree can be fabricated from polymeric resins such as polycarbonate, acrylics, or polyvinyl chloride, for example, or from metals such as ferrous alloys, or from ceramic or glass, or from wood, or a combination of these materials. The forepart 111 includes vent openings 112 to allow circulation of air. A narrow, elongated spine 113 extends longitudinally from the forepart 111 and possesses a laterally oriented crossbar 114. Aperture 104 in the spine 113 is adapted to receive screw 103 for fastening to a lamp support frame 115, discussed below.

Adapter piece 120 is part of the shoe tree and includes a heel 125, a handle 121, and two side panels 122 which define between them an elongated longitudinal space for the reception therein of the spine 113. The side panels 122 each include a series of spaced apart notches 123, each notch of one side panel 122 being aligned with a corresponding notch on the other side panel 122 to form a notch pair adapted to receive the end portions of laterally oriented crossbar 114. By choosing the notches 123 into which crossbar 114 is engaged the relative position of the adapter piece 120 with respect to the forepart 111 and spine 113 can be chosen to adapt the shoe tree 110 to the length of any size shoe. Alternatively, one of the two side panels 122 can have circular openings rather than notches to receive one end portion of crossbar 114.

Means for mounting a light source can include a lamp support frame 115. Lamp support frame 115 includes a flat base 116 having apertures 118, and an elongated rod 117 having an aperture 119. Rod 117 is adapted to align with spine 113 with screw 103 being disposed through aperture 103 in the spine 113 and aperture 119 in the rod 117 to connect the spine 113 to the lamp support frame 115. Alternatively, support frame 115 can be fastened by bonding methods such as adhesion, solvent welding, ultrasonic welding, melt fusion, or any other method appropriate to the materials of construction of the shoe tree. In yet another alternative, the lamp support frame 115 can be integrally fabricated with the shoe tree such that the forepart 111, spine 113 and lamp support frame 115 are of single piece construction. Molding or casting methods may be employed to integrally construct the lamp support frame with the forepart 111 and spine 113.

Flat base 116 is adapted to support receptacle 133 by means of connecting screws 102 disposed through apertures 135 in the receptacle support flange 134 and apertures 118 in the flat support base 116.

The electrically operated disinfecting apparatus includes a disinfectant lamp 130 having light emitting tubular bulbs 131 connected to a base 132. The lamp 130 is positioned underneath the forepart 111 of the shoe tree. The bulbs 131 are adapted to emit biologically active light capable of destroying or inhibiting the growth of microorganisms. For example, bulbs 131 preferably can emit light at least a portion of which is ultraviolet ("UV"), which may be longwave UV radiation (about 3000 Å–4000 Å) or shortwave UV (about 2000 Å to 3000 Å). Since the most pronounced biocidal effects are with shortwave UV, the light bulbs preferred for use in the present invention are those adapted to emit at least a portion of the light in shortwave UV. Lamps useful for the purposes described herein are commercially available, for example, from Phillips Lighting Company of Somerset, N.J.

An illustrative mounting mechanism of FIG. 1 includes base 132, which is adapted to be inserted into socket 139 in receptacle 133 in a snap fit engagement by means of snap fit latch 136. Prongs 137 of the base 132 are inserted into apertures 138 of the receptacle and provide electrical contact.

Receptacle 133 has a support flange 134 having apertures 135. As mentioned above, receptacle 133 is fastened to the flat base 116 by means of connecting screws 102 being disposed through apertures 135 and 118.

Referring to FIG. 1, the receptacle 133 is electrically connected to outlet 141 of control box 140 by means of electrical line 142 containing conductive wires. Control box 140 can optionally contain a programmable timer to switch the lamp 130 on and off at predetermined intervals. Timers suitable for use in the control box 140 may be a conventional manually controlled timer or a digital alarm-clock type timer. Also, control box 140 can optionally contain an electrical ballast for lamp 130. Such ballasts provide the voltage required by the light source, usually a stepped-up voltage. A ballast capable of providing voltages for a plurality of light sources may also be used for a plurality of shoe-trees in accordance to the present mention. A ballast for use in the invention described herein is readily commercially available, for example, from Robertson Transformer Company of Blue Island, Ill. Alternatively, the ballast can be contained within base 132 or receptacle 133.

Electrical line 143 connects control box 140 to plug 144. Prongs 145 of plug 144 are adapted for insertion into any standard 110 volt electrical wall outlet.

Figure 1A:
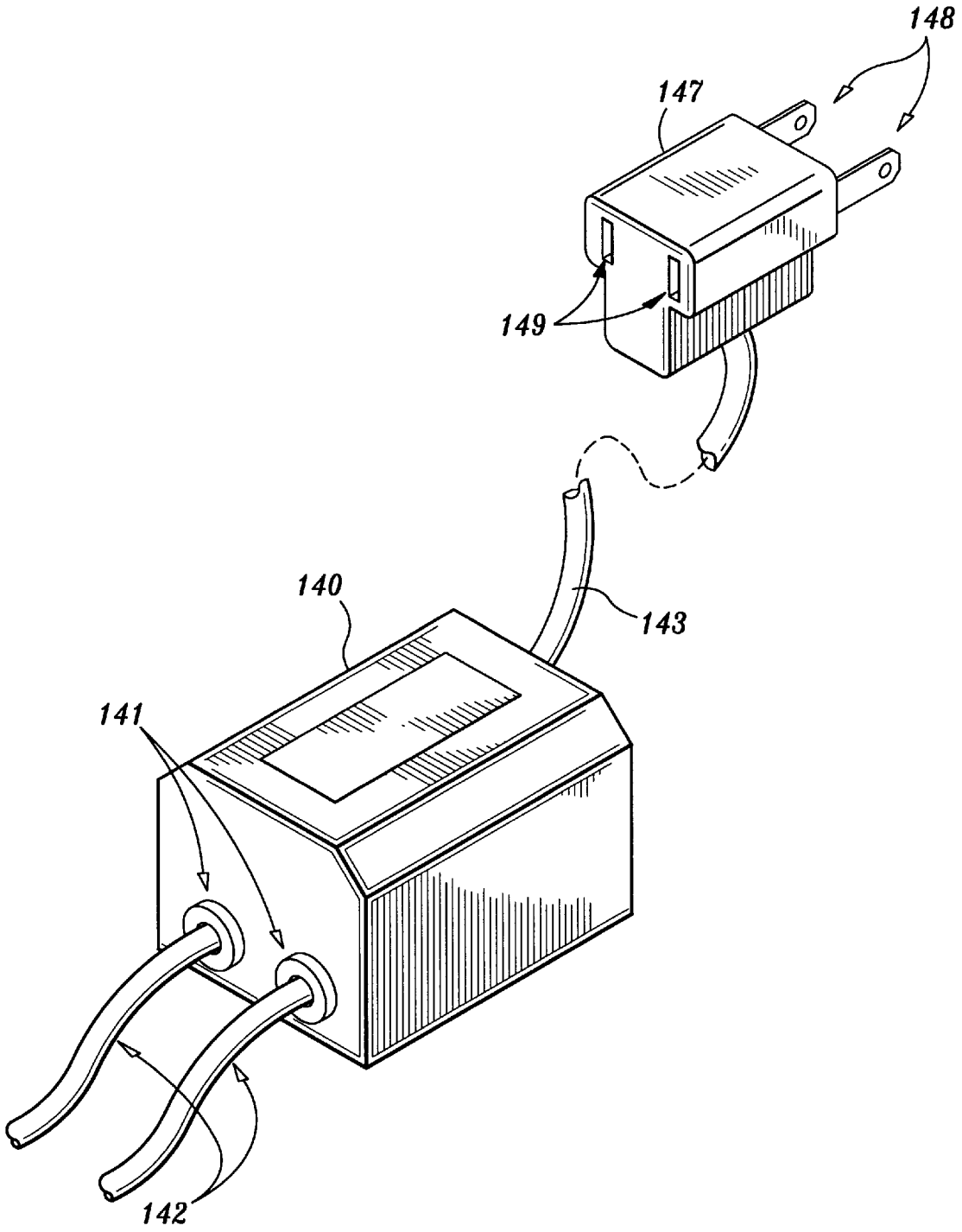
FIG. 1A is a perspective view of an alternative embodiment of the control box and electric plug.
Figure 2:
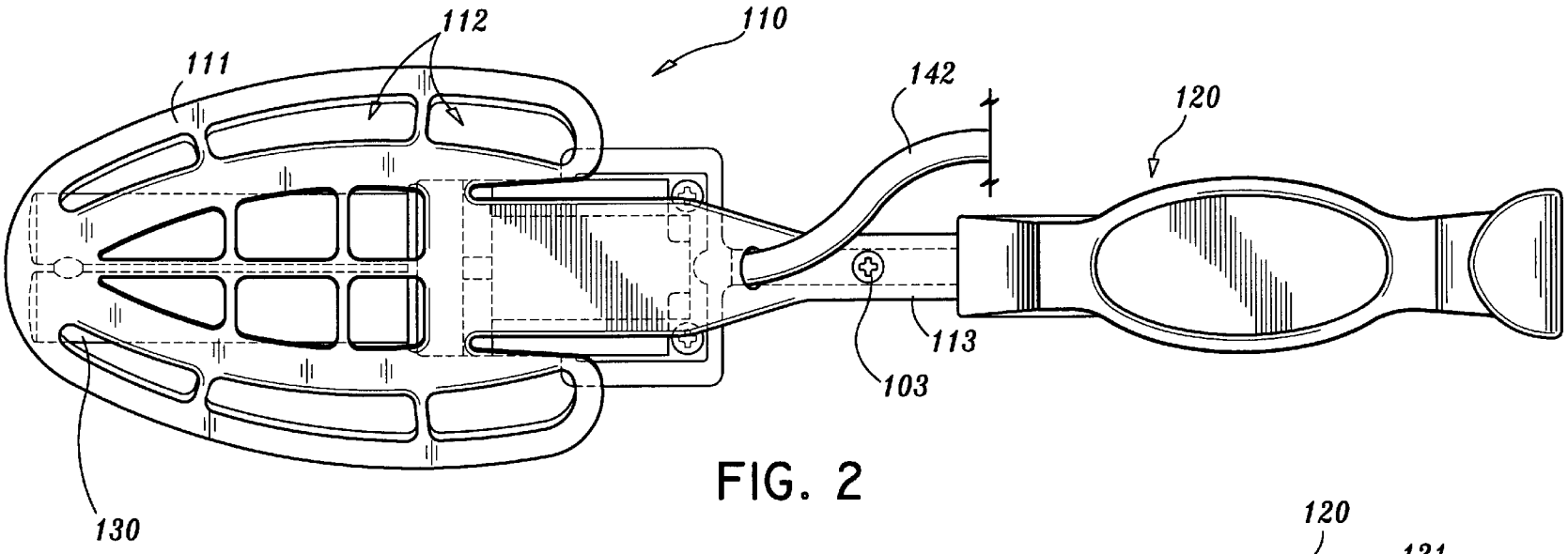
FIGS. 2 and 3 are, respectively, top and side views of the shoe tree assembly.
Figure 3:
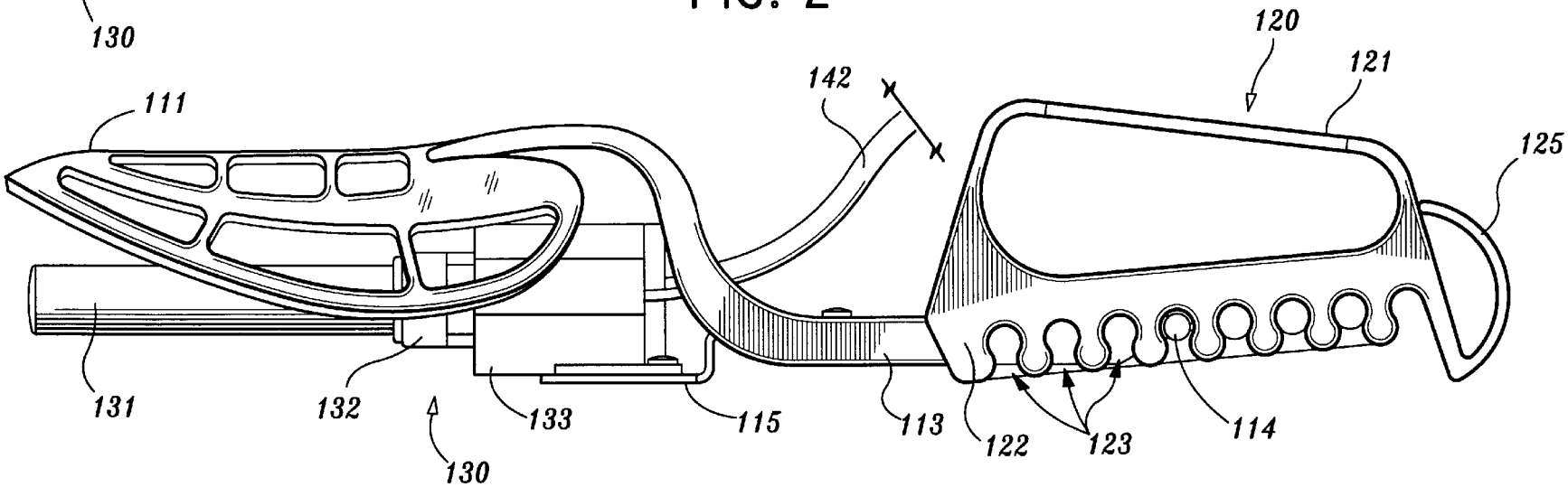
Figure 4:
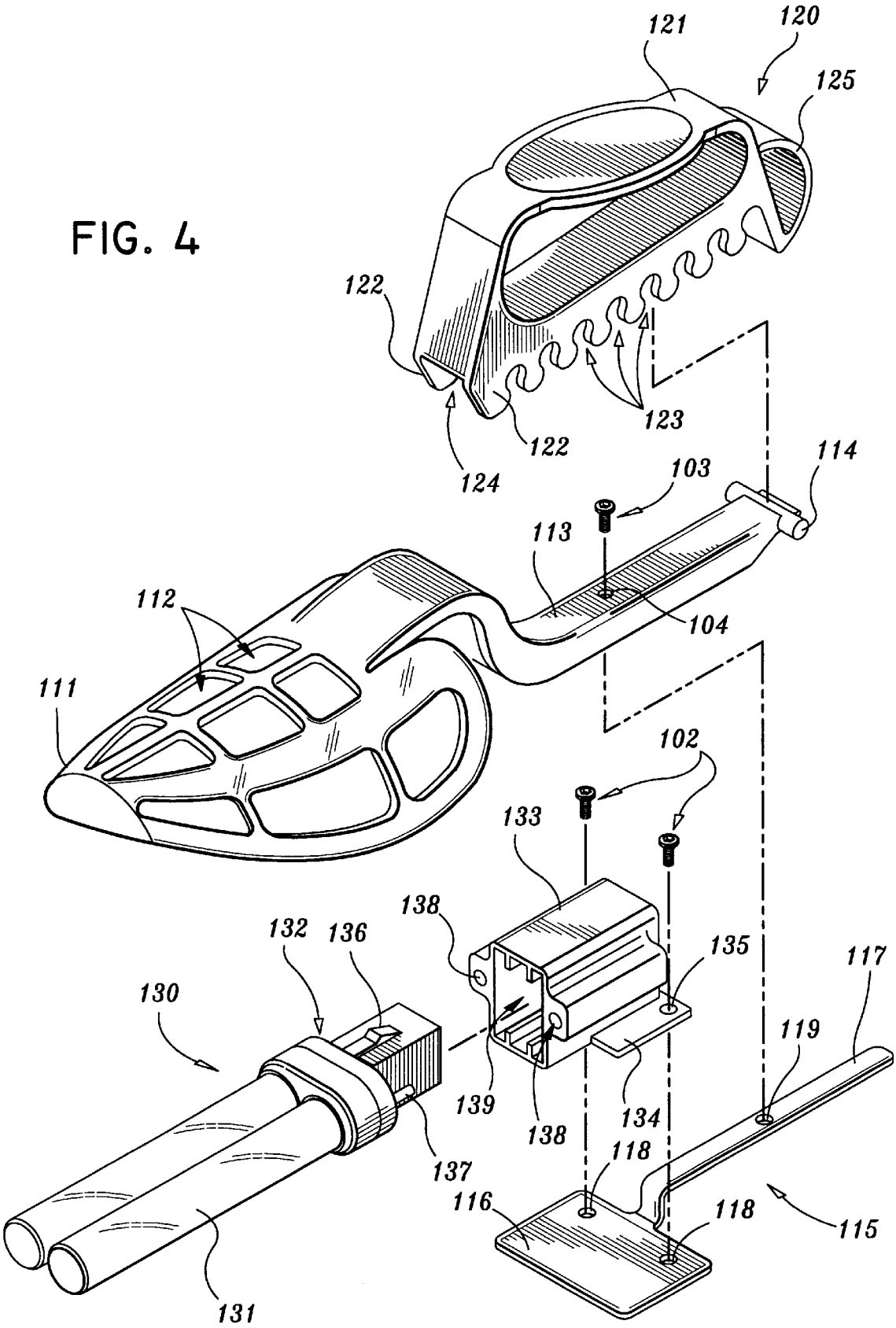
FIG. 4 is an exploded perspective view of the shoe tree assembly.

Referring also now to FIG. 1A, in an alternative embodiment plug 147 includes both prongs 148 and prong receptacles 149 to receive a prong pair from another plug. Thus, plug 147 enables plugs of two or more apparatus to be electrically connected to the same wall outlet. Moreover, control box 140 may have two or more outlets 141 so that multiple disinfecting lamps can be connected to the same control box 140. A pair of shoes can be treated simultaneously, rather than one shoe at a time.

Figure 5:
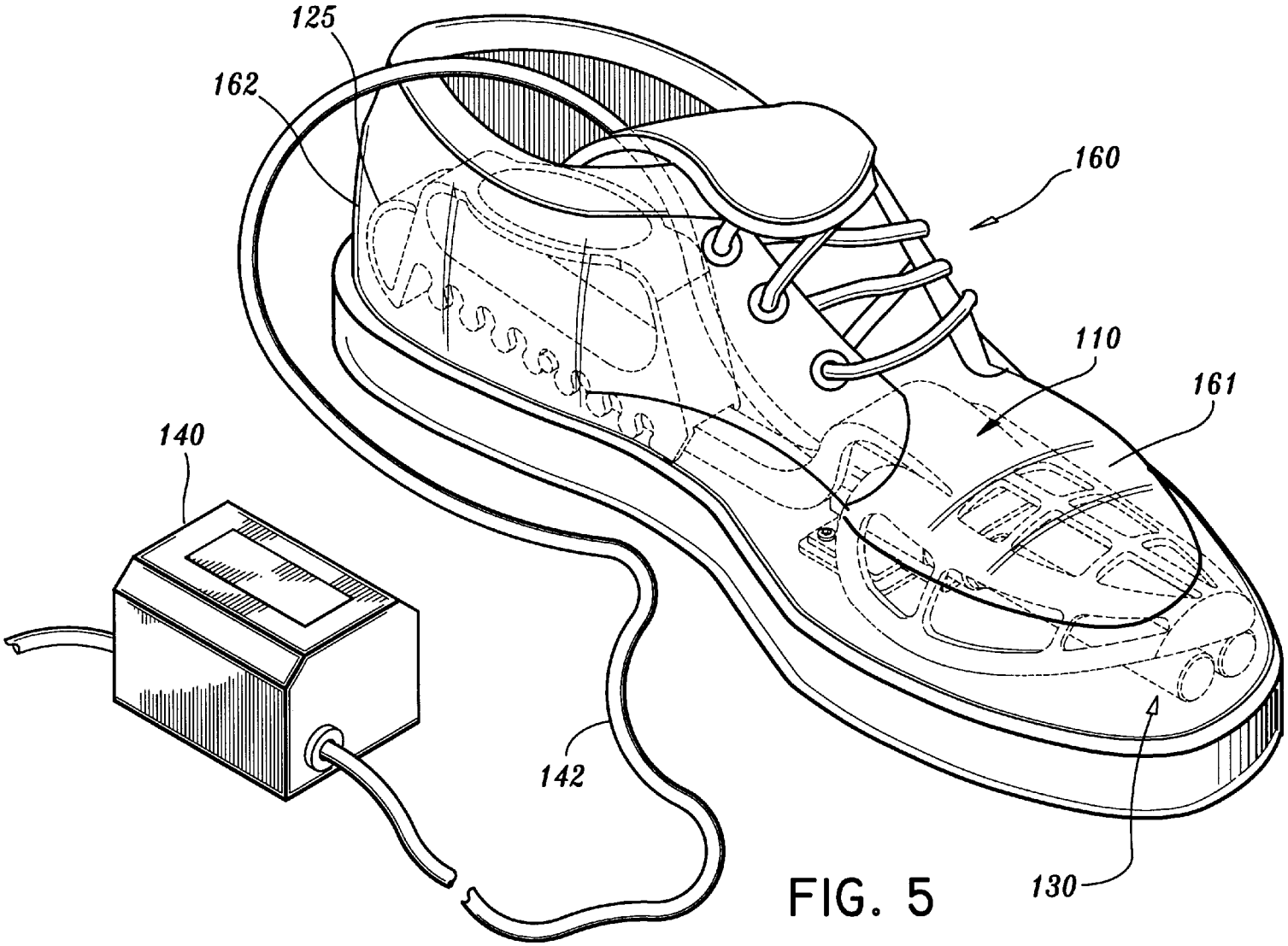
FIG. 5 is a perspective view illustrating use of the shoe tree assembly for disinfecting a shoe.

Referring now to FIG. 5, the shoe tree 110 with attached disinfecting lamp 130 is inserted into a shoe 160, the forepart 111 of the shoe tree being inserted into the vamp portion 161 of the shoe 160. The adapter piece 120 is adjusted such that the heel 125 is snug against the back 162 of the shoe. Disinfecting lamp 130 is then actuated, providing a source of actinic radiation, such as UV light, to destroy, or suppress the growth of fungi or other organisms. Vent openings 112 not only permit the circulation of air but also allow the light to penetrate therethrough.

The above described device provides a convenient means to treat one or more shoes. The user simply inserts the shoe tree assembly into the interior of the shoe and activates the apparatus. Optionally the user can preset the timer switch for a predetermined period of light exposure.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

What is claimed is:

1. A shoe tree assembly comprising:

a shoe tree having a forepart and a spine extending from said forepart, said forepart formed to insertingly fit into an interior of a shoe;

means for adjusting the size of said shoe tree;

at least one light source connected to the shoe tree and being capable of emitting a biocidal wavelength of light for preventing fungus growth within the shoe; and means for mounting said at least one light source to said spine of said shoe tree such that said at least one light source is disposed within said forepart.

2. The shoe tree according to claim 1, wherein said biocidal wavelength of light further comprises an ultraviolet light source.

3. The shoe tree according to claim 1, wherein said mounting means further comprises:

a lamp support frame having an elongated rod for connection to said spine;

a flat base portion at an end of said rod; and a lamp receptacle connected to said flat base portion.

4. The shoe tree according to claim 3, wherein said lamp receptacle and said at least one light source further comprise locking means for releasably locking said at least one light source into said receptacle.

5. A method for treating a shoe, comprising:

providing a shoe tree having a forepart and a spine extending from said forepart, said forepart formed to insertingly fit into an interior of a shoe;

adjusting the size of said shoe tree;

emitting from at least one light source connected to the shoe tree a biocidal wavelength of light for preventing fungus growth within the shoe; and mounting said at least one light source to said spine of said shoe tree such that said at least one light source is disposed within said forepart.

6. The shoe tree according to claim 5, wherein said biocidal wavelength of light further comprises an ultraviolet light source.

* * * * *